US011685642B2

(12) United States Patent
Lotan

(10) Patent No.: US 11,685,642 B2
(45) Date of Patent: Jun. 27, 2023

(54) CONTROLLED LIQUID POURER AND A METHOD FOR LIQUOR CONSUMPTION

(71) Applicant: Nina Labs Ltd., Binyamina (IL)

(72) Inventor: Tal Lotan, Ramat Gan (IL)

(73) Assignee: NINA LABS LTD., Biny Amina (IL)

( * ) Notice: Subject to any disclaimer, the term of this patent is extended or adjusted under 35 U.S.C. 154(b) by 0 days.

(21) Appl. No.: 17/644,094

(22) Filed: Dec. 13, 2021

(65) Prior Publication Data

US 2022/0274824 A1 Sep. 1, 2022

Related U.S. Application Data

(60) Provisional application No. 63/091,939, filed on Oct. 15, 2020.

(51) Int. Cl.
*B67D 3/00* (2006.01)
*B65D 47/32* (2006.01)

(52) U.S. Cl.
CPC ..... *B67D 3/0051* (2013.01); *B65D 47/32* (2013.01)

(58) Field of Classification Search
CPC .... B67D 3/0051; B67D 3/0045; B65D 47/32; B65D 50/062
See application file for complete search history.

(56) References Cited

U.S. PATENT DOCUMENTS 3,233,783 A * 2/1966 Thornton ..... A62C 13/003 222/568
3,235,133 A * 2/1966 Zimmerman ..... B65D 47/06 222/189.06
3,782,610 A * 1/1974 Gilbert ..... B65D 47/263 222/484
4,595,126 A * 6/1986 Holmes ..... A45F 3/16 285/200
4,946,079 A * 8/1990 Campbell ..... B67D 3/048 222/548
5,505,349 A * 4/1996 Peckels ..... G01F 13/006 222/641
5,961,008 A * 10/1999 Peckels ..... G01F 11/265 222/569
2002/0074366 A1* 6/2002 Young ..... B65D 47/268 222/525
2002/0104854 A1* 8/2002 Jensen ..... B67D 3/0003 222/481.5
2012/0118431 A1* 5/2012 Dickie ..... B65D 47/249 141/311 R
2022/0274824 A1* 9/2022 Lotan ..... B65D 47/32

* cited by examiner

*Primary Examiner* — Bob Zadeh
(74) *Attorney, Agent, or Firm* — Reches Patents

(57) ABSTRACT

A controlled liquid pourer that may include a liquid path, an air path, a flow control mechanism that is configured to control, during a liquid consumption iteration, (a) a flow of liquor from a bottle and through the liquid path, and (b) a flow of air through the air path and into the bottle, a mechanical coupling mechanism and a locking mechanism configured to selectively lock the controlled liquid pourer to the bottle.

26 Claims, 20 Drawing Sheets

CONTROLLED LIQUID POURER AND A METHOD FOR LIQUOR CONSUMPTION

BACKGROUND

It has been found that liquor is distributed, consumed and paid for in a very inefficient, inaccurate and a limiting manner. The amounts of consumed liquor are not properly measured, the amount and types of consumed liquor are not reported in a proper manner, and entire process is mostly manual—under the supervision of bartenders.

A controlled liquid pourer may be connected to a bottle and may attempt to prevent unauthorized consumption of liquid from the bottle.

Users may attempt to disconnect the controlled liquid pourer from the bottle.

These is a growing need to provide an efficient and secure controlled liquid pourer

SUMMARY

There may be provided a controlled liquid pourer that may include a liquid path, an air path, a flow control mechanism that may be configured to control, during a liquid consumption iteration, (a) a flow of liquor from a bottle and through the liquid path, and (b) a flow of air through the air path and into the bottle; a locking mechanism configured to selectively lock the controlled liquid pourer to the bottle, and a mechanical coupling mechanism.

The locking mechanism and the flow control mechanism may share a threaded rotatable element that may be configured to move, by rotation, between a bottle locking position in which the threaded rotating element presses bottle locking elements against the bottle; and a bottle release position in which the threaded rotating does not press the bottle locking elements against the bottle.

The mechanical coupling mechanism may be configured to (a) allow, under a bottle release condition, to rotate the threaded rotatable element at a release direction and reach the bottle release position, and (b) prevent, under a bottle lock condition, a rotation of the rotatable upper housing at the release direction.

The mechanical coupling mechanism may include a first interfacing element that has a first interfacing part and a second interfacing part, and a second interfacing element that may be movable between (a) a first position in which the second interfacing element contacts the first interfacing part while not contacting the second interfacing part, and (b) a second position in which the second interfacing element contacts the second interfacing part while not contacting the first interfacing part; wherein when the first interfacing part may be configured to allow a rotation at the release direction; and wherein the second interfacing part may be configured to prevent the rotation at the release direction.

The second interfacing part may be movable by gravitation between the first position and the second position.

The second interfacing part may be a gravity ring.

The flow control mechanism may include a first liquid conduit, a first liquid conduit movement mechanism, a main air conduit that passes through the threaded rotatable element, a first liquid seal that may be connected to the main air conduit, a first flow control element and a second flow control element.

The first liquid conduit movement mechanism may be configured to move the first liquid conduit between a distal position and a proximal position.

When the first liquid conduit is positioned at the distal position, a first air conduit within the first flow control element may be misaligned with a second air conduit of the second flow control element, and the liquid seal seals the threaded rotatable element.

At least one of the first flow control element and the second flow control element may include one or more seals for sealing the first air conduit from the second air conduit—when the first air conduit and the second air conduit are misaligned.

When the first liquid conduit is positioned at the proximal position, the first air conduit may be aligned with the second air conduit, and the liquid seal may be spaced apart from the threaded rotatable element.

The controlled liquid pourer may include a limiter mechanism that may be configured to prevent a movement of the first liquid conduit towards the bottle when the first liquid conduit may be at a first fluid conduit position and to allow the movement of the first liquid conduit to the preform the movement from the distal location to the proximal position.

The limiter mechanism may include springs and pins; wherein the springs are configured to force the pin to move towards an interior of the first liquid conduit.

The limiter mechanism may include a springs housing that may include spring spaces in which the springs are positioned; and a pins housing that may include pins spaces in which the pins are positioned; wherein the springs housing may be movable in relation to the pins housing.

The first liquid conduit may be configured to move the springs housing when moved by the first liquid conduit movement mechanism.

The air path may be formed, at least in part, by one or more openings of a rotatable housing, a first air conduit within the first flow control element, a second air conduit of the second flow control element, and the main air conduit.

There may be provided a controlled liquid pourer that may include a liquid path, an air path, a locking mechanism configured and a flow control mechanism that may be configured to control, during a liquid consumption iteration, (a) a flow of liquor from a bottle and through the liquid path, and (b) a flow of air through the air path and into the bottle.

The locking mechanism may be configured to selectively lock the controlled liquid pourer to the bottle.

The flow control mechanism may include a first liquid conduit, a first liquid conduit movement mechanism, a main air conduit that passes through a threaded rotatable element, a first liquid seal that may be connected to the main air conduit, a first flow control element and a second flow control element; and wherein the first liquid conduit movement mechanism may be configured to move the first liquid conduit between a distal position and a proximal position.

When the first liquid conduit is positioned at the distal position, a first air conduit within the first flow control element may be misaligned with a second air conduit of the second flow control element, and the liquid seal seals the threaded rotatable element.

The first liquid conduit may be positioned at the distal position, a first air conduit within the first flow control element may be misaligned with a second air conduit of the second flow control element, and the liquid seal seals the threaded rotatable element.

The at least one of the first flow control element and the second flow control element may include one or more seals for sealing the first air conduit from the second air conduit—when the first air conduit and the second air conduit are misaligned.

When the first liquid conduit is positioned at the proximal position, the first air conduit may be aligned with the second air conduit, and the liquid seal may be spaced apart from the threaded rotatable element.

The controlled liquid pourer may include a limiter mechanism that may be configured to prevent a movement of the first liquid conduit towards the bottle when the first liquid conduit may be at a first fluid conduit position and to allow the movement of the first liquid conduit to the preform the movement from the distal location to the proximal position.

The limiter mechanism may include springs and pins; wherein the springs are configured to force the pin to move towards an interior of the first liquid conduit.

The limiter mechanism may include a springs housing that may include spring spaces in which the springs are positioned; and a pins housing that may include pins spaces in which the pins are positioned; wherein the springs housing may be movable in relation to the pins housing.

The first liquid conduit may be configured to move the springs housing when moved by the first liquid conduit movement mechanism.

The air path may be formed, at least in part, by one or more openings of a rotatable housing, a first air conduit within the first flow control element, a second air conduit of the second flow control element, and the main air conduit.

The locking mechanism and the flow control mechanism share the threaded rotatable element, wherein the threaded rotatable element may be configured to move, by rotation, between a bottle locking position in which the threaded rotating element presses bottle locking elements against the bottle; and a bottle release position in which the threaded rotating does not press the bottle locking elements against the bottle.

The controlled liquid pourer may include a mechanical coupling mechanism that may be configured to (a) allow, under a bottle release condition, to rotate the threaded rotatable element at a release direction and reach the bottle release position, and (b) prevent, under a bottle lock condition, a rotation of the rotatable upper housing at the release direction.

There may be provided a method for controlling a provision of liquid using any of the controlled liquid pourer s mentioned in the application.

BRIEF DESCRIPTION OF THE DRAWINGS

The subject matter regarded as the embodiments of the disclosure is particularly pointed out and distinctly claimed in the concluding portion of the specification. The embodiments of the disclosure however, both as to organization and method of operation, together with objects, features, and advantages thereof, may best be understood by reference to the following detailed description when read with the accompanying drawings in which:

DETAILED DESCRIPTION OF THE DRAWINGS

Figure 1:
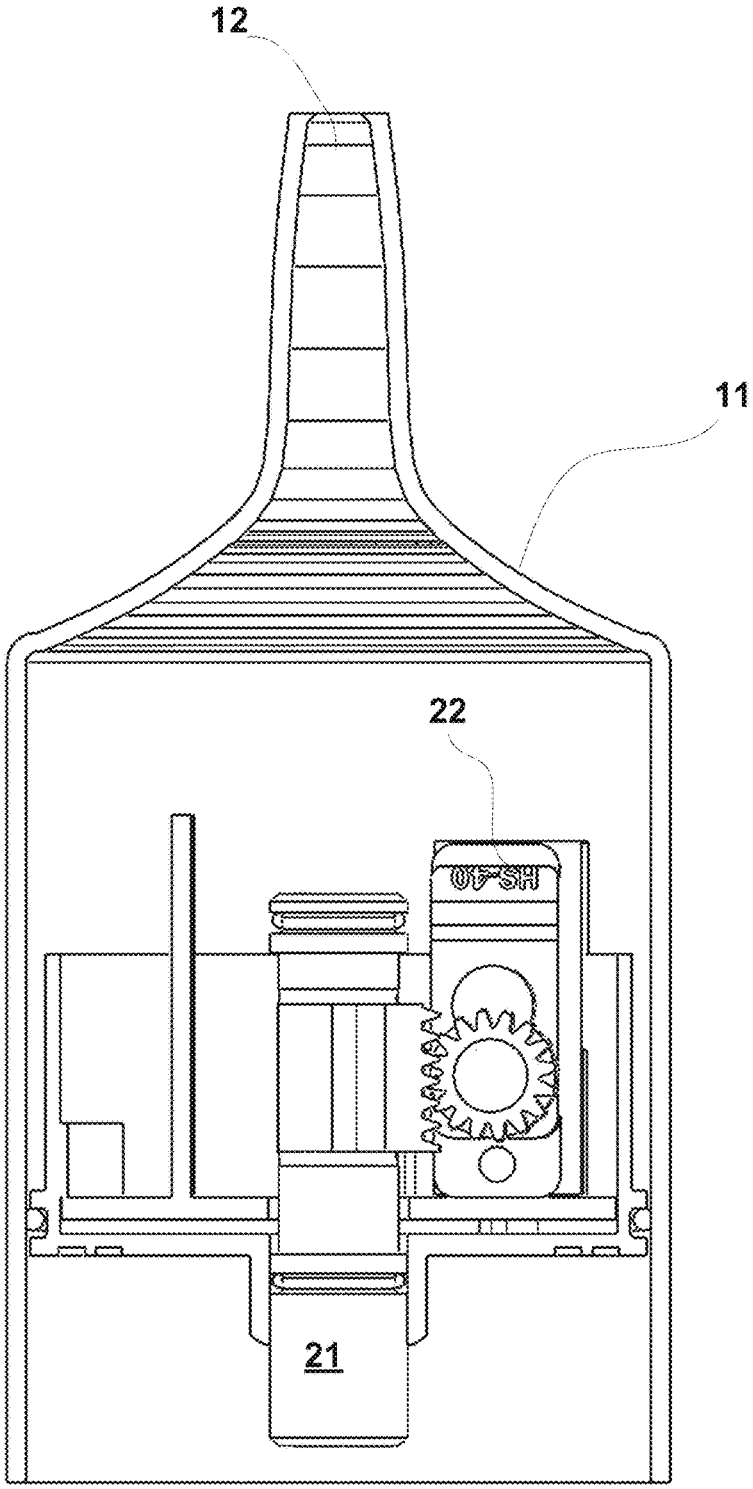
FIGS. 1-20 illustrate examples of at least parts of a controlled pourer with or without at least one part of the bottle.
Figure 2:
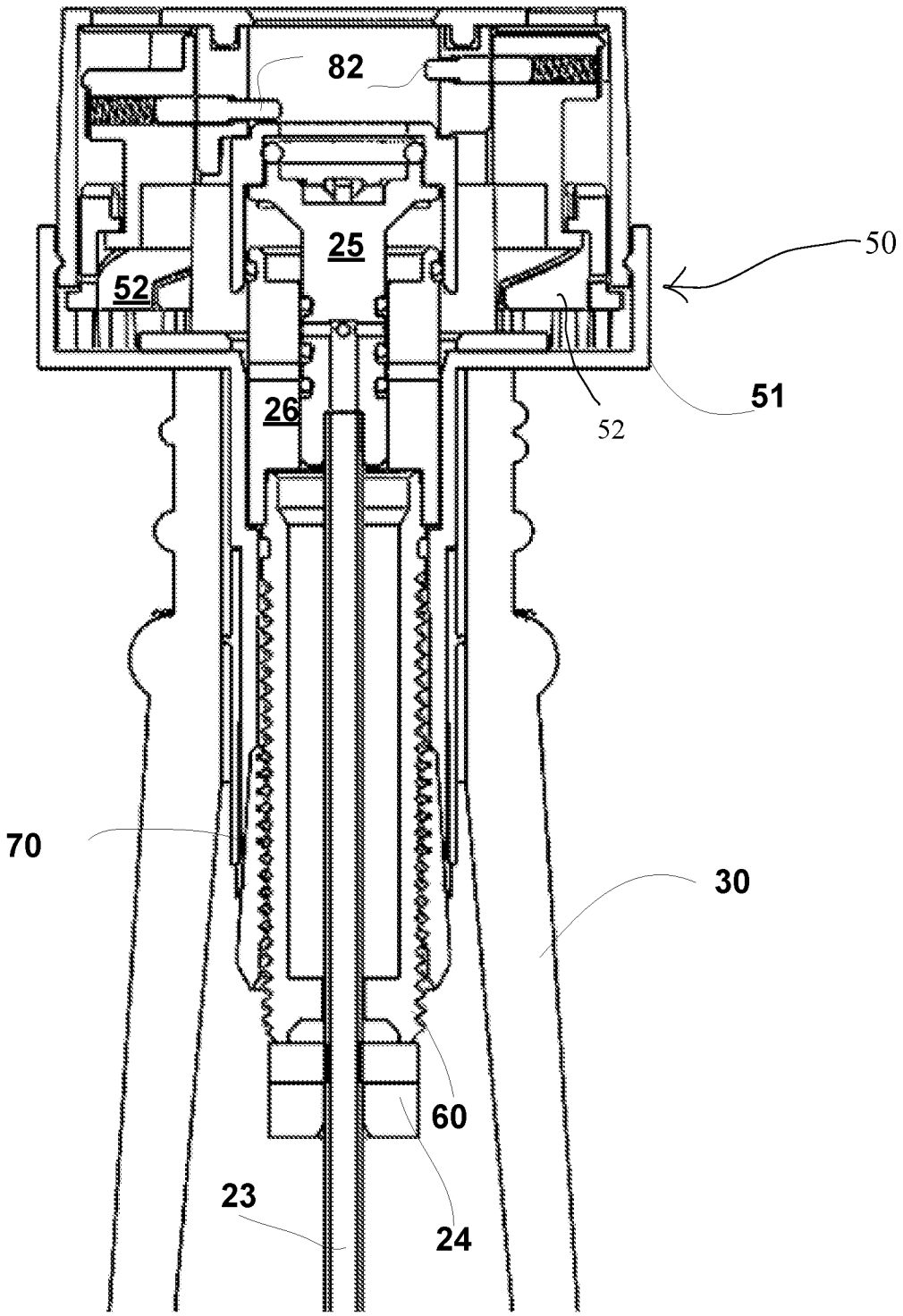
Figure 3:
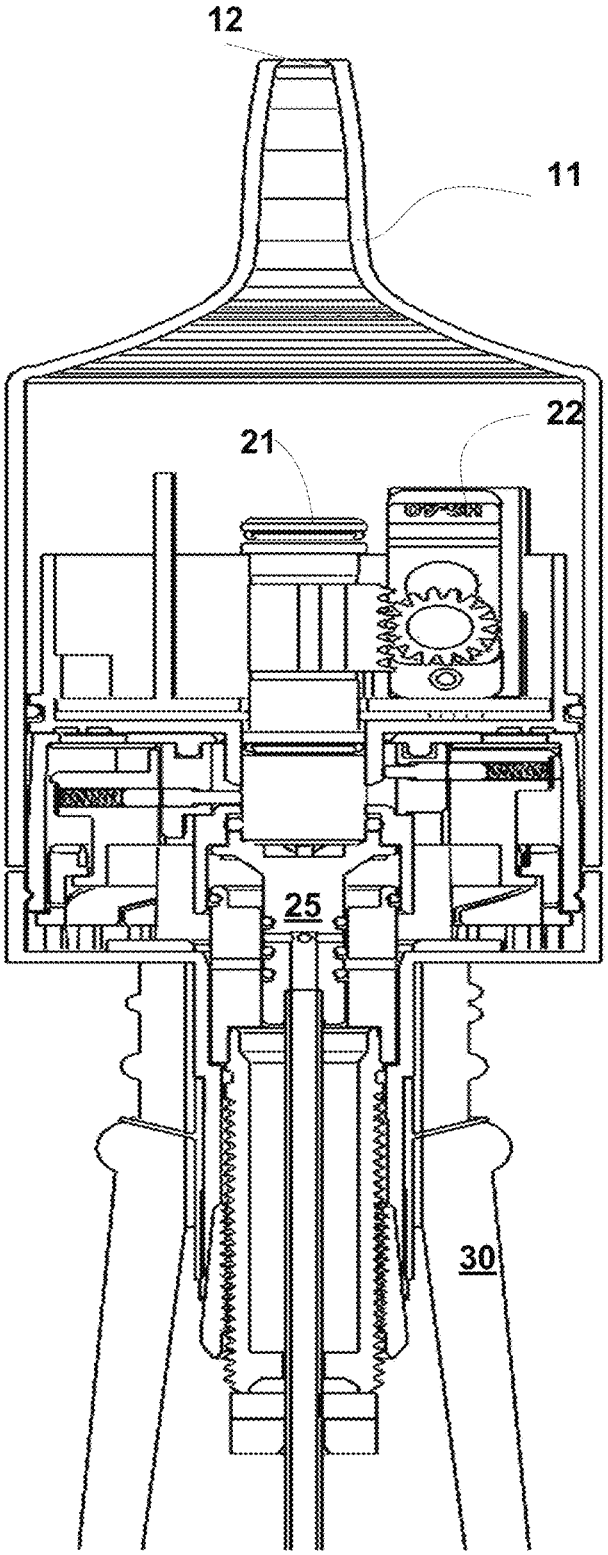
Figure 4:
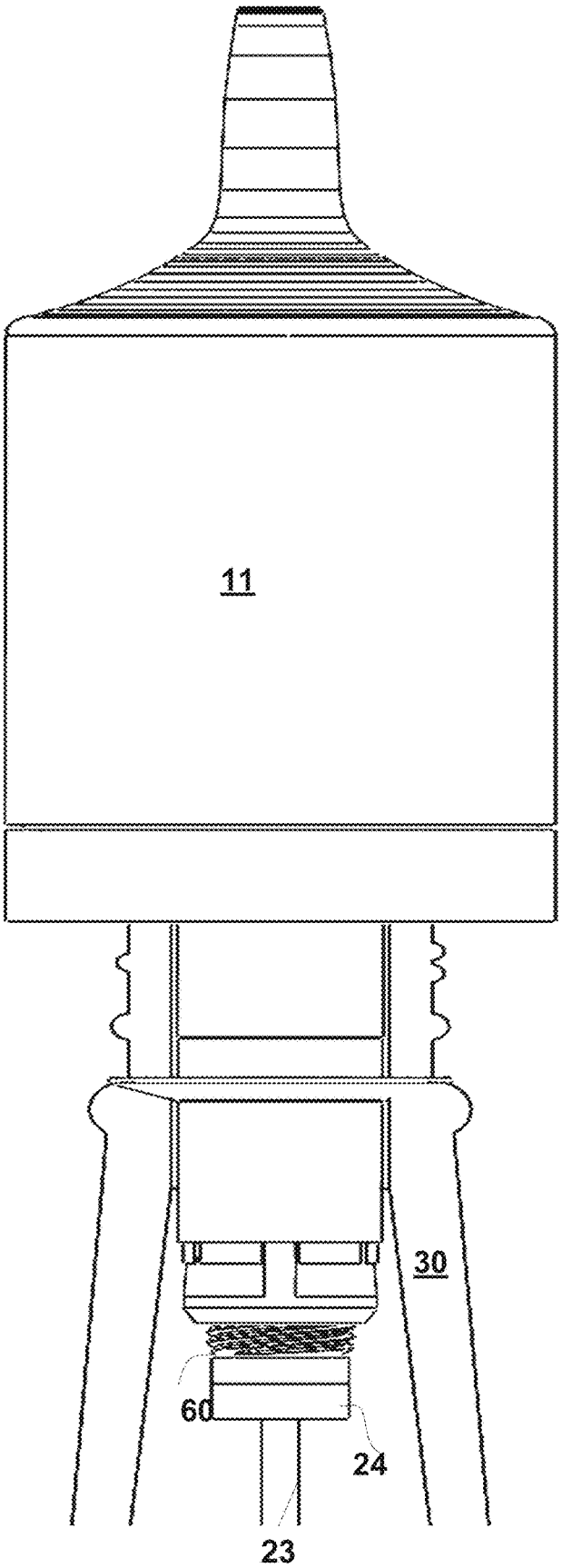

In the following detailed description, numerous specific details are set forth in order to provide a thorough understanding of the embodiments of the disclosure.

However, it will be understood by those skilled in the art that the present embodiments of the disclosure may be practiced without these specific details. In other instances, well-known methods, procedures, and components have not been described in detail so as not to obscure the present embodiments of the disclosure.

The subject matter regarded as the embodiments of the disclosure is particularly pointed out and distinctly claimed in the concluding portion of the specification. The embodiments of the disclosure however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Because the illustrated embodiments of the disclosure may for the most part, be implemented using electronic components and circuits known to those skilled in the art, details will not be explained in any greater extent than that considered necessary as illustrated above, for the understanding and appreciation of the underlying concepts of the present embodiments of the disclosure and in order not to obfuscate or distract from the teachings of the present embodiments of the disclosure Any reference in the specification to a method should be applied mutatis mutandis to a system capable of executing the method and should be applied mutatis mutandis to a computer readable medium that is non-transitory and stores instructions for executing the method.

Any reference in the specification to a system should be applied mutatis mutandis to a method that may be executed by the system and should be applied mutatis mutandis to a computer readable medium that is non-transitory and stores instructions executable by the system.

Any reference in the specification to a computer readable medium that is non-transitory should be applied mutatis mutandis to a method that may be applied when executing instructions stored in the computer readable medium and should be applied mutatis mutandis to a system configured to execute the instructions stored in the computer readable medium.

The term "and/or" means additionally or alternatively.

There may be provided a controlled liquid pourer that may control the output of liquor from a bottle while preventing unauthorized disconnection of the controlled liquid pourer from the bottle and while allowing an authorized disconnection of the controlled liquid pourer from the bottle.

The authorized disconnection may include positioning the bottle and the controlled liquid pourer at one or more certain conditions and remotely controlling a position of one of the components of the controlled liquid pourer (for example a position of a first liquid conduit) to enable the authorized disconnection.

Unauthorized disconnection may be prevented by a combination of a limiter mechanism and by mechanically preventing certain movement of one or more other components of the controlled liquid pourer—for example preventing rotations along a release direction.

Figure 5:
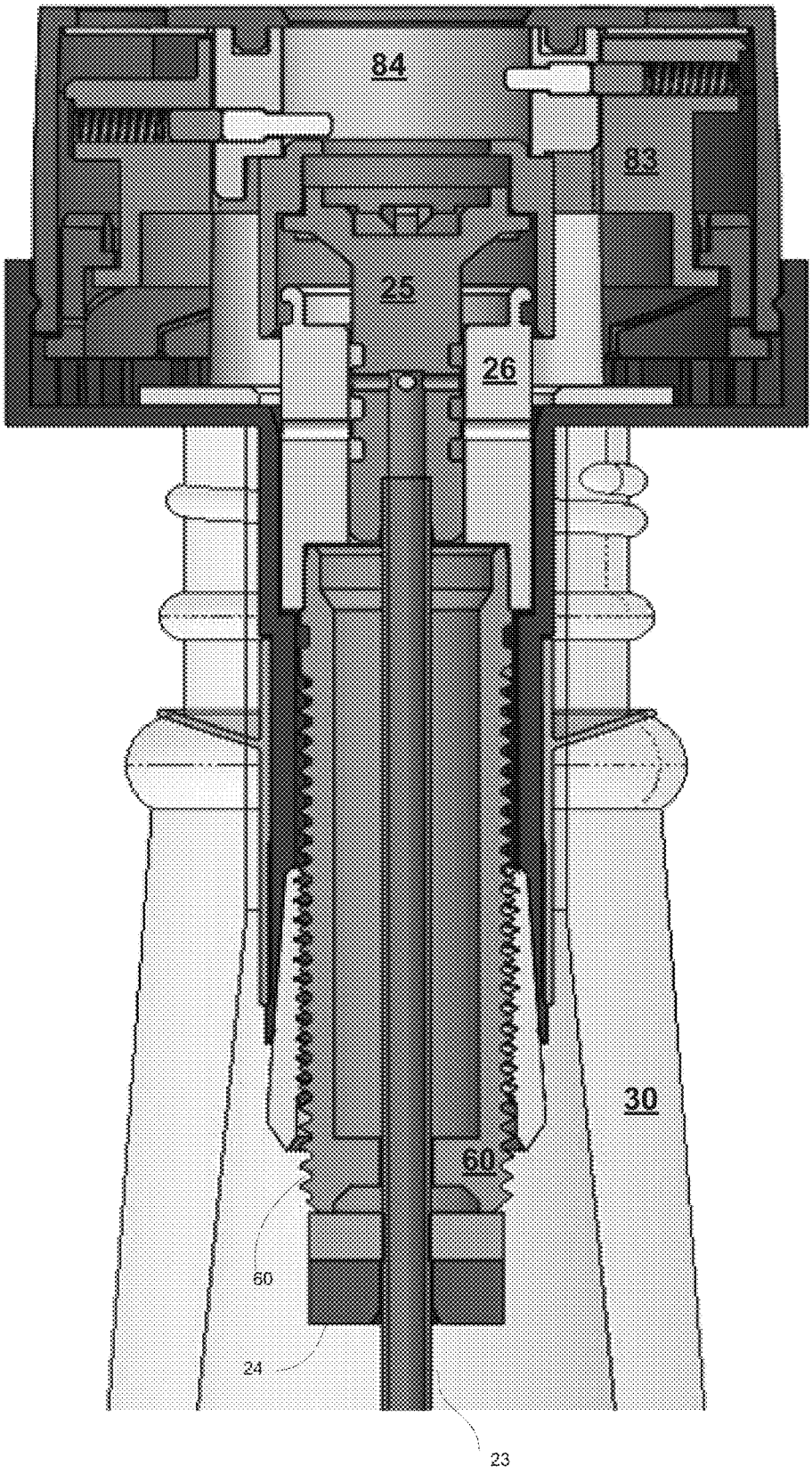
Figure 6:
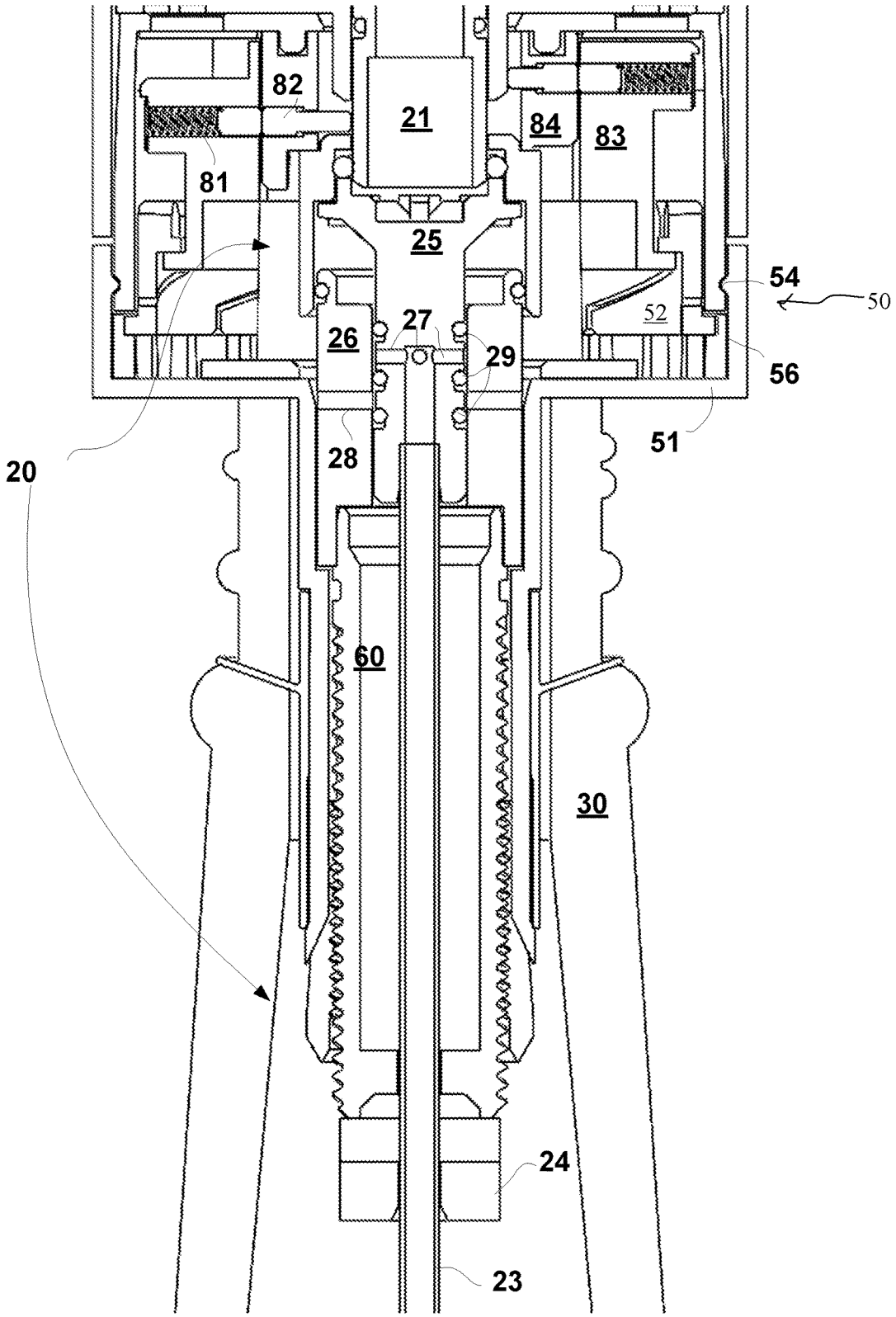
Figure 7:
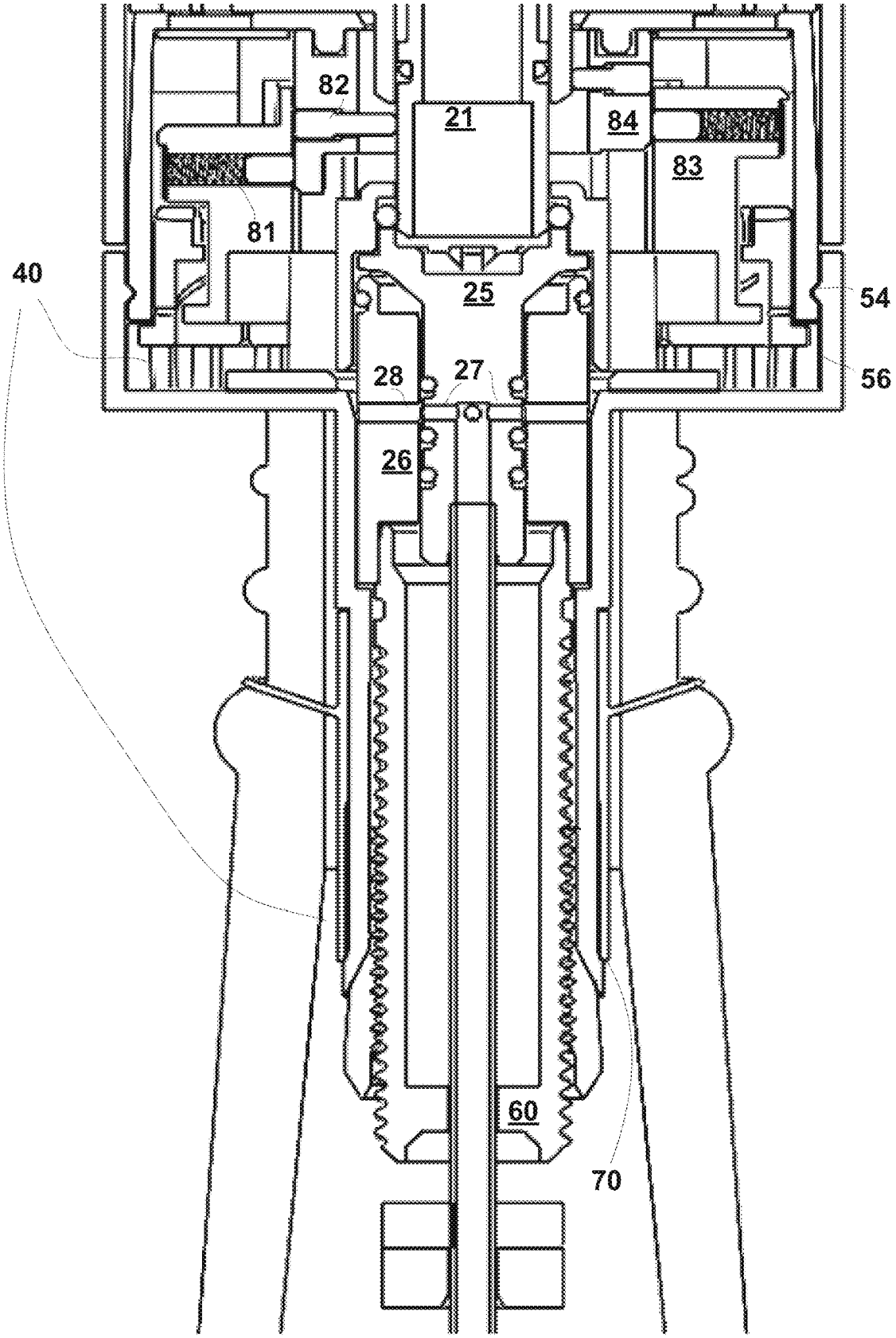
Figure 8:
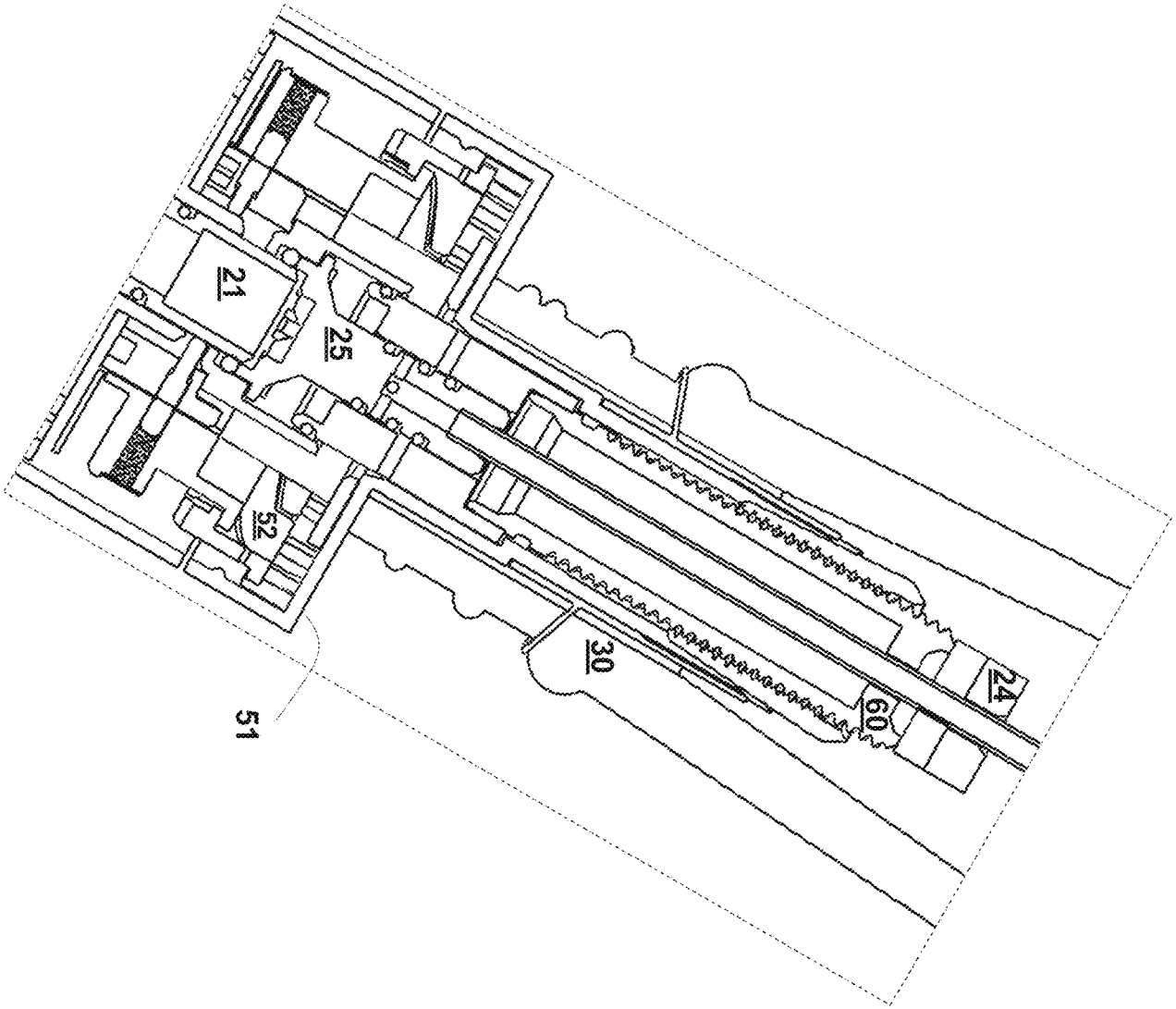
Figure 9:
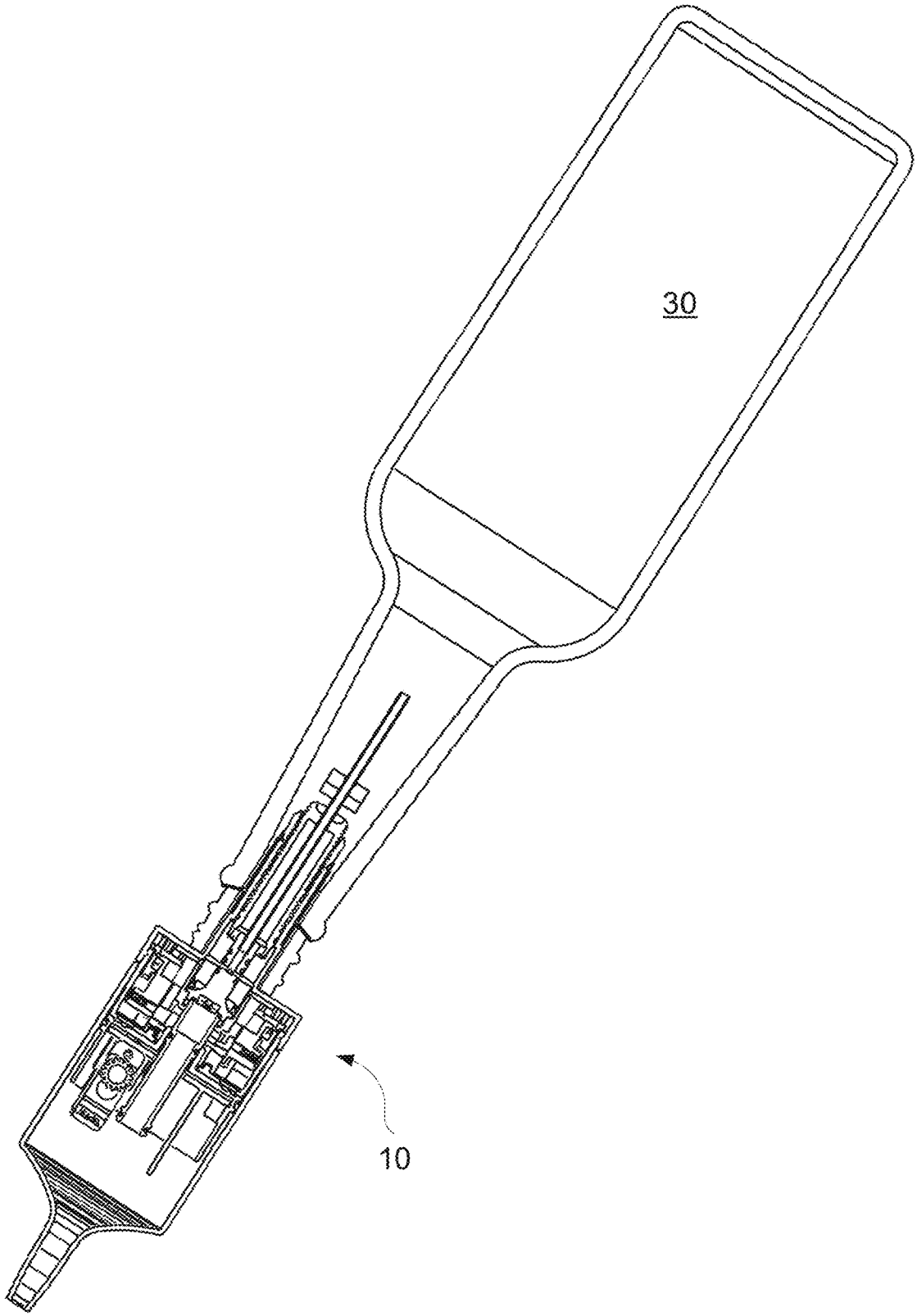
Figure 10:
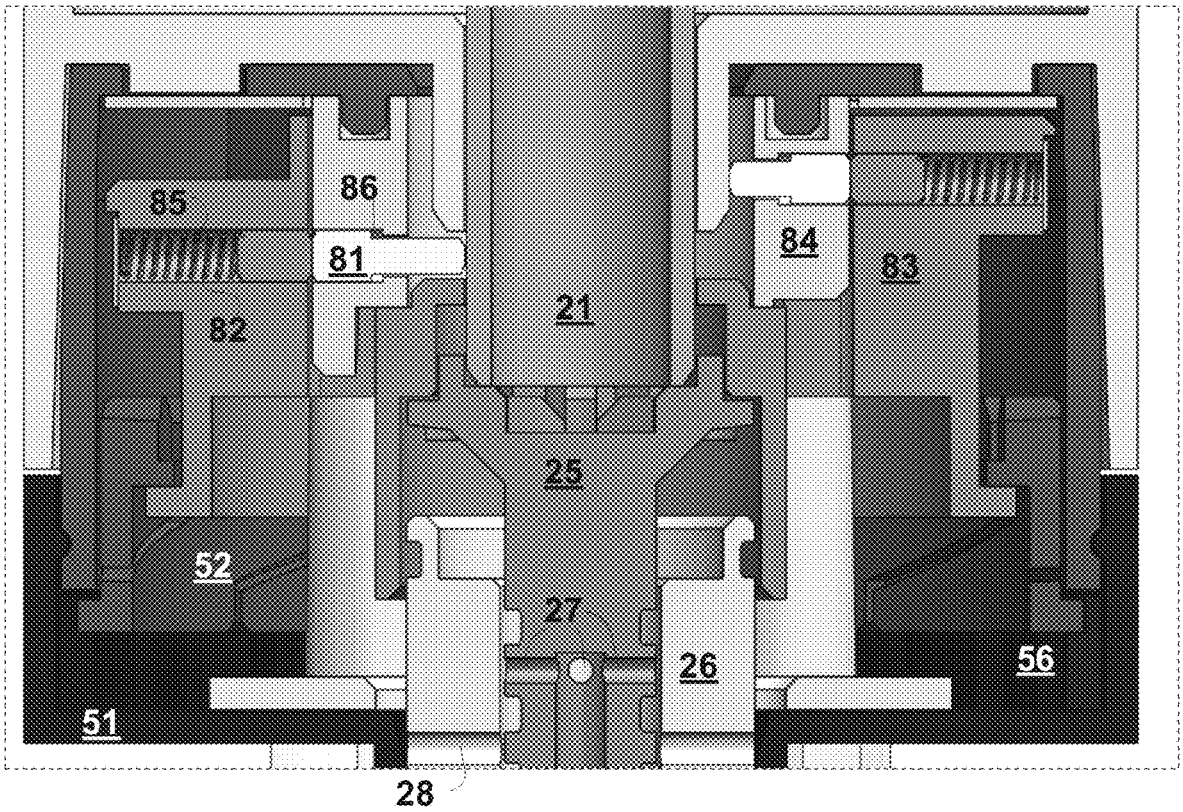
Figure 11:
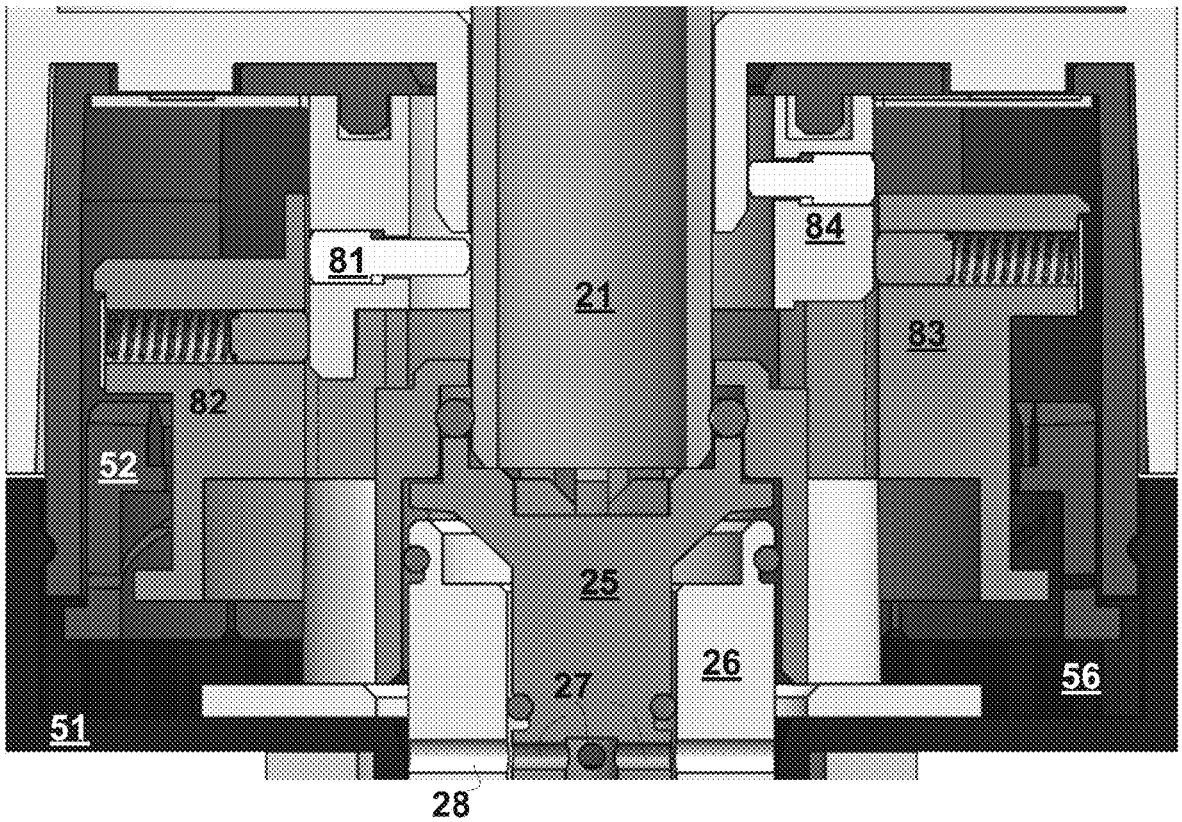
Figure 12:
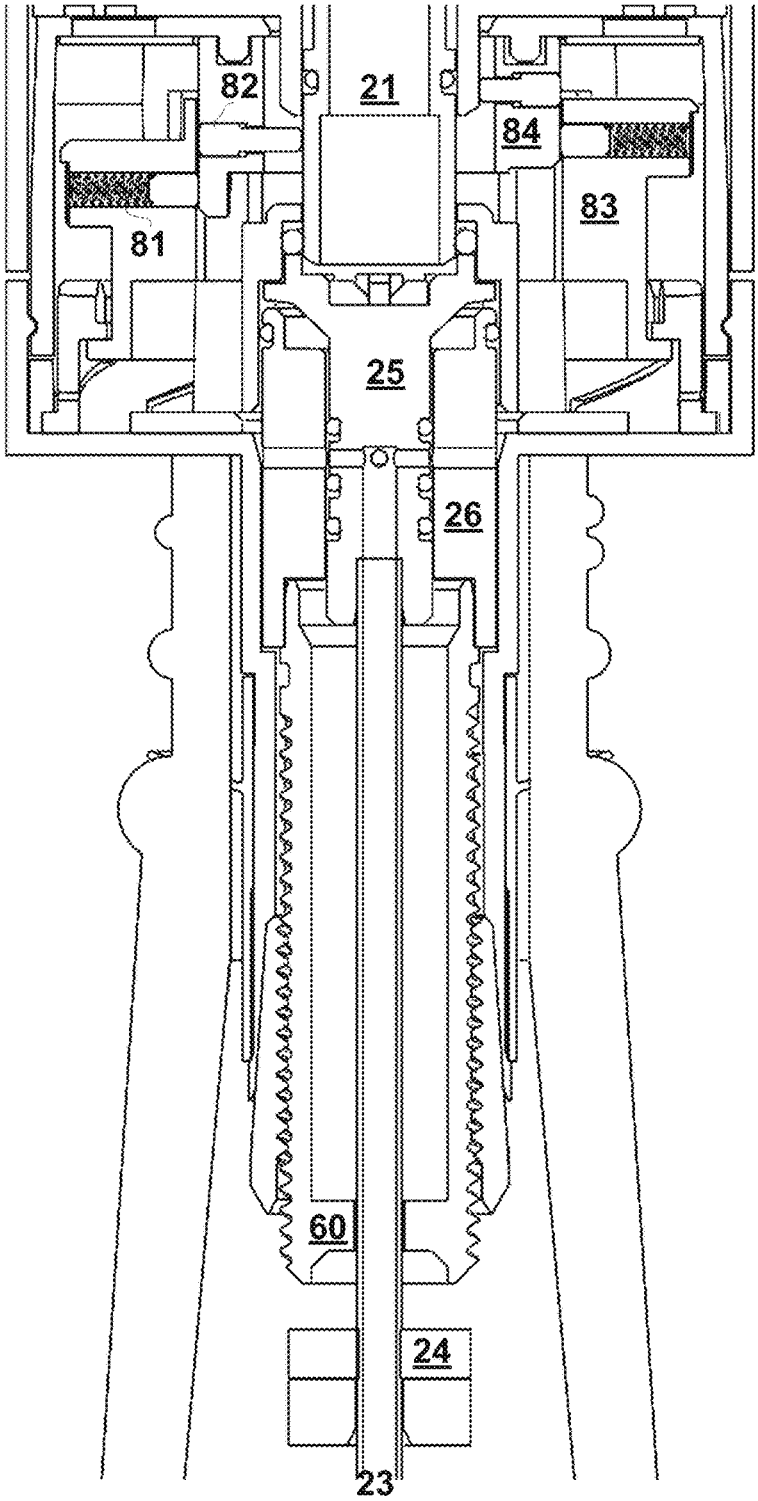
Figure 13:
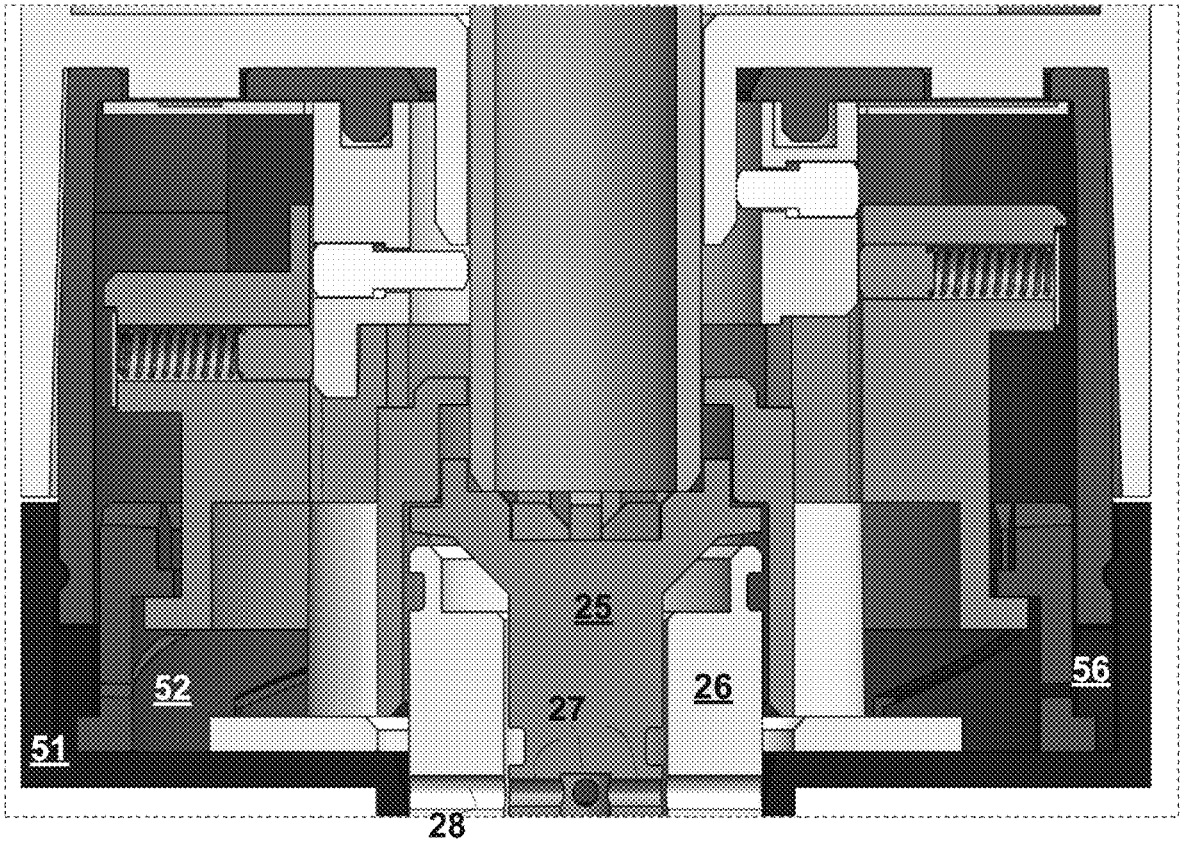
Figure 14:
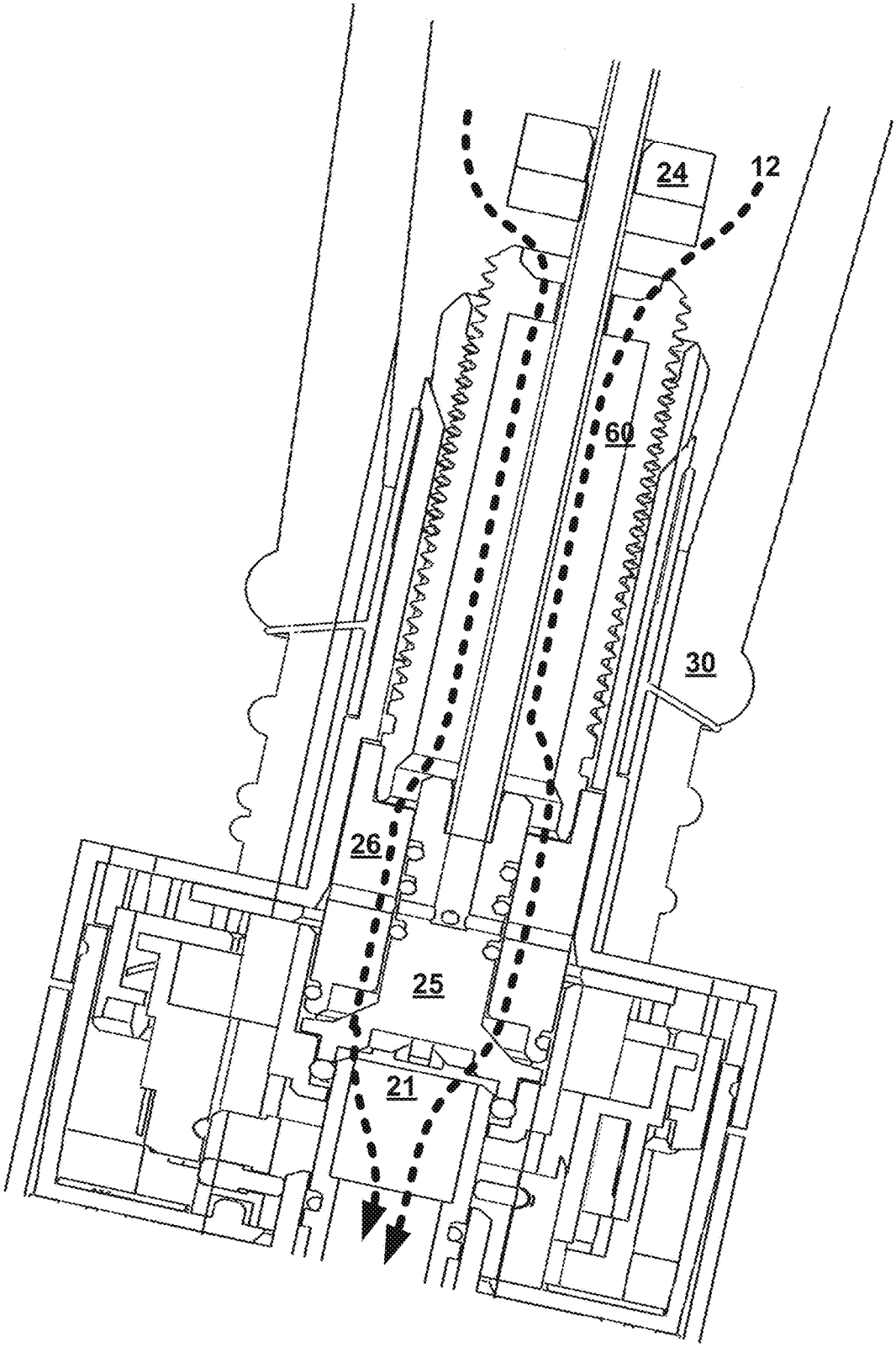
Figure 15:
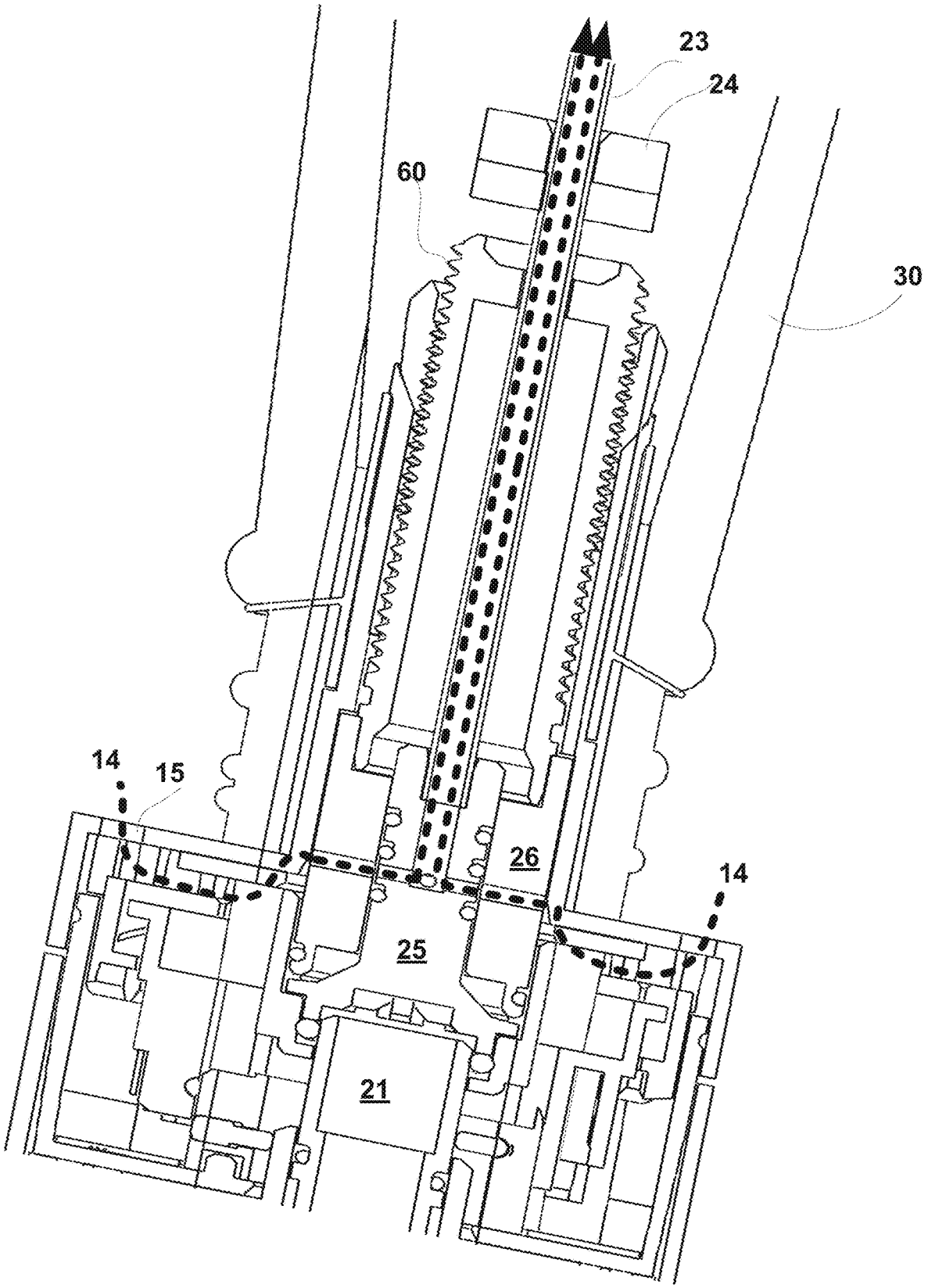
Figure 16:
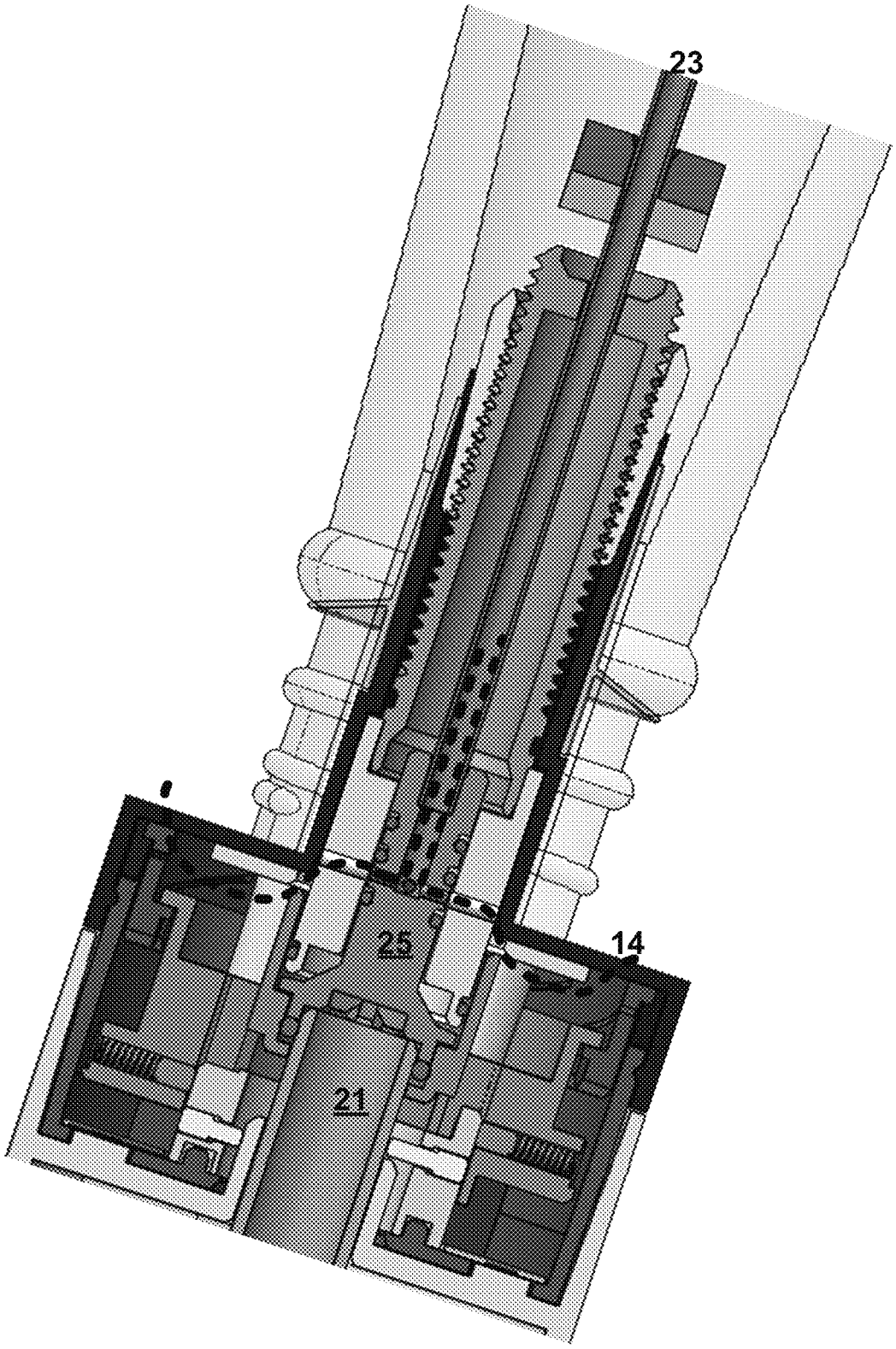
Figure 17:
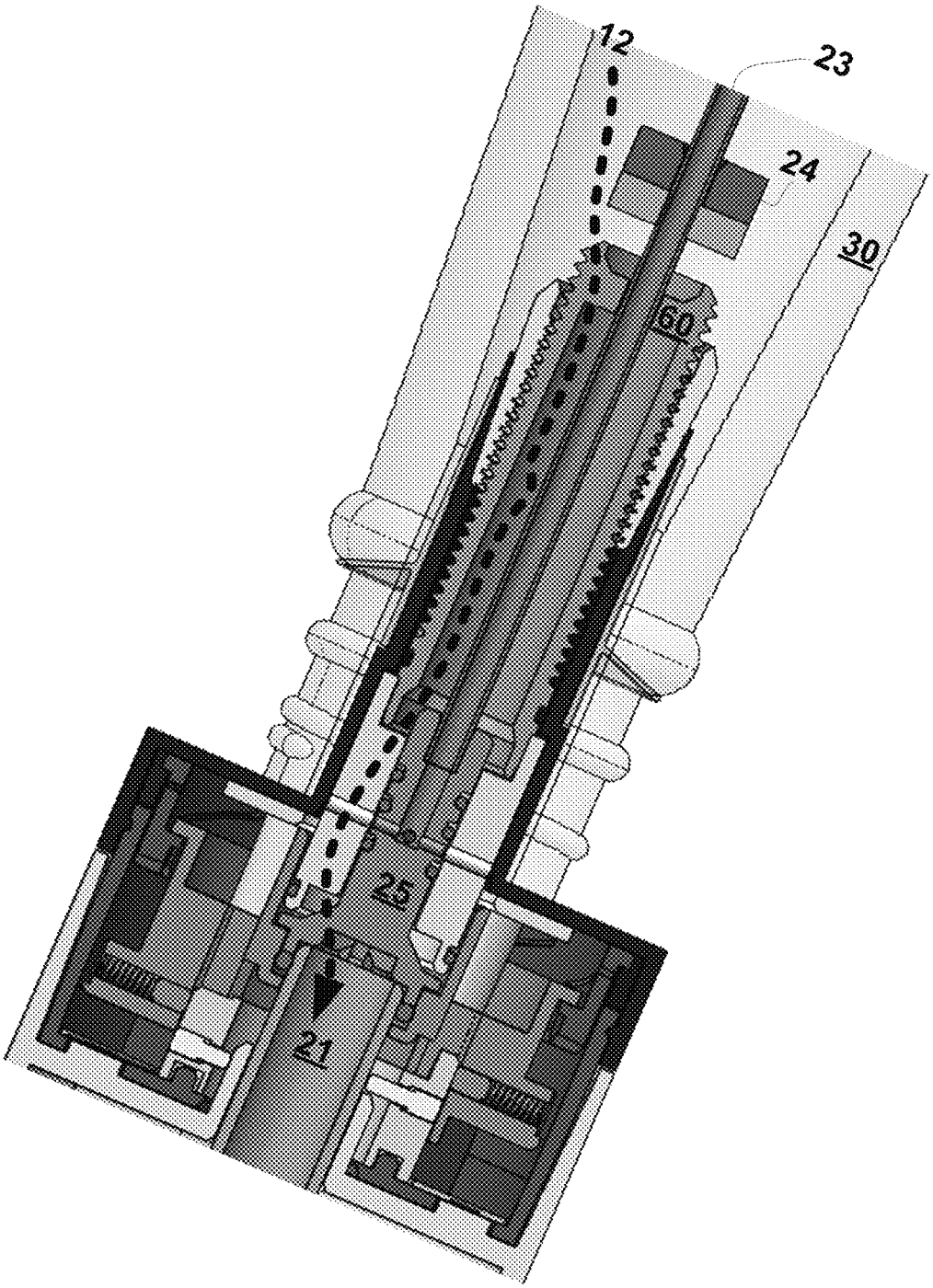
Figure 18:
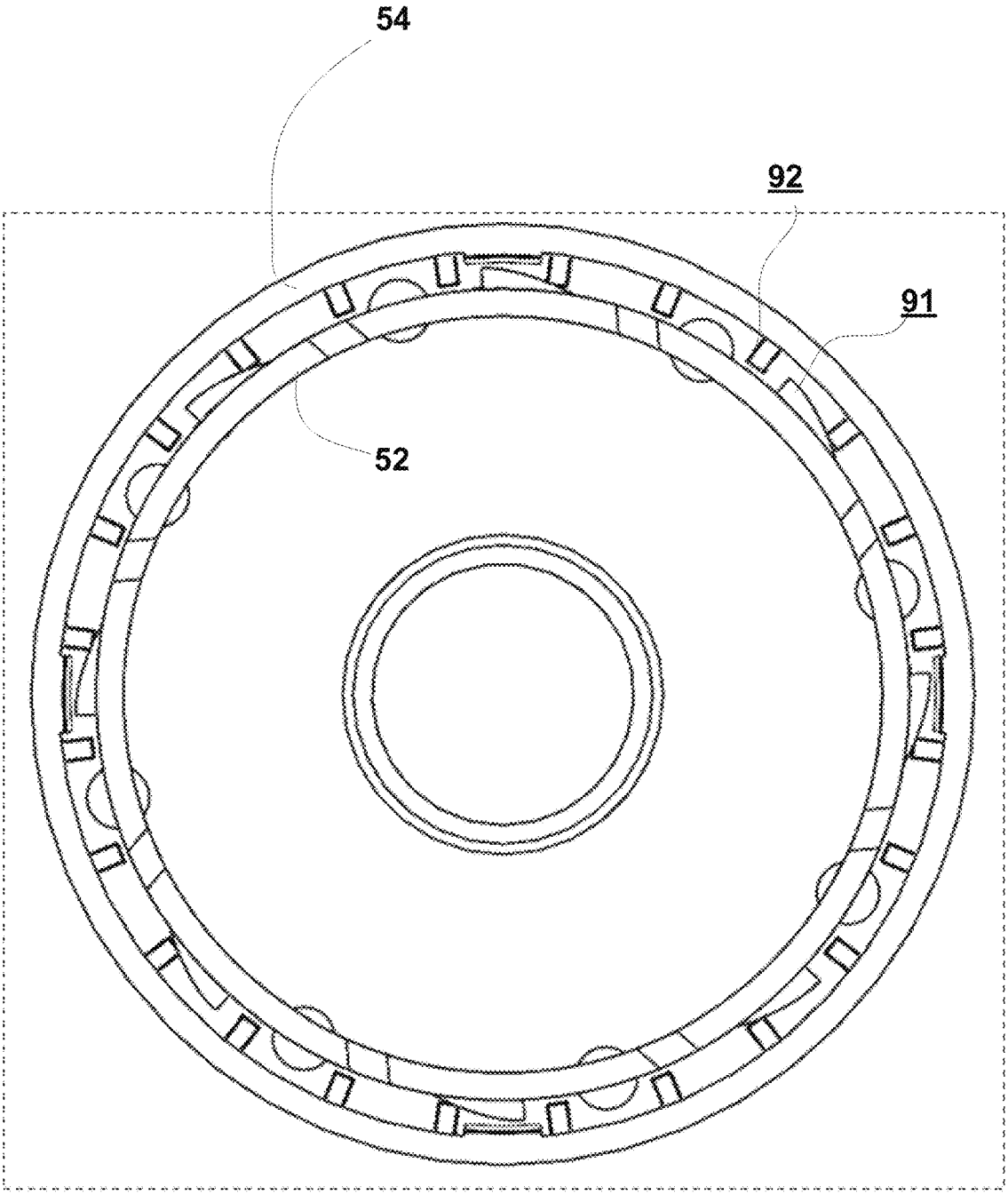

FIGS. 1-18 illustrate examples of at least parts of the controlled pourer with or without at least parts of the bottle. Especially FIGS. 5-6 and 10 illustrate a closed potion, FIGS. 7 and 11 illustrates an open position, FIGS. 8-9 and 4-17 illustrate a pouring position, and FIGS. 12-13 illustrates an unlock position. FIG. 18 is a top view of first and second interfacing elements.

Figure 19:
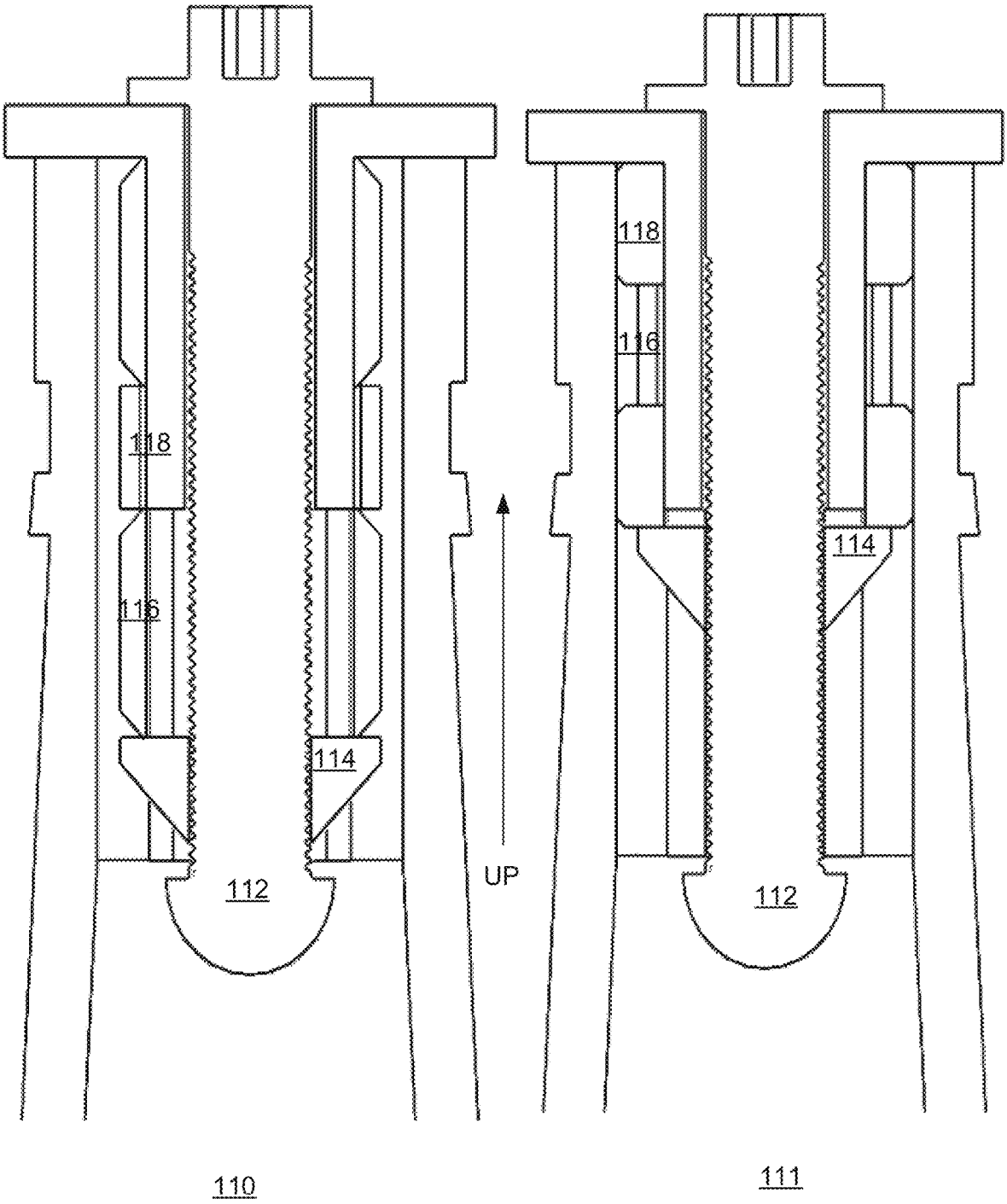
Figure 20:
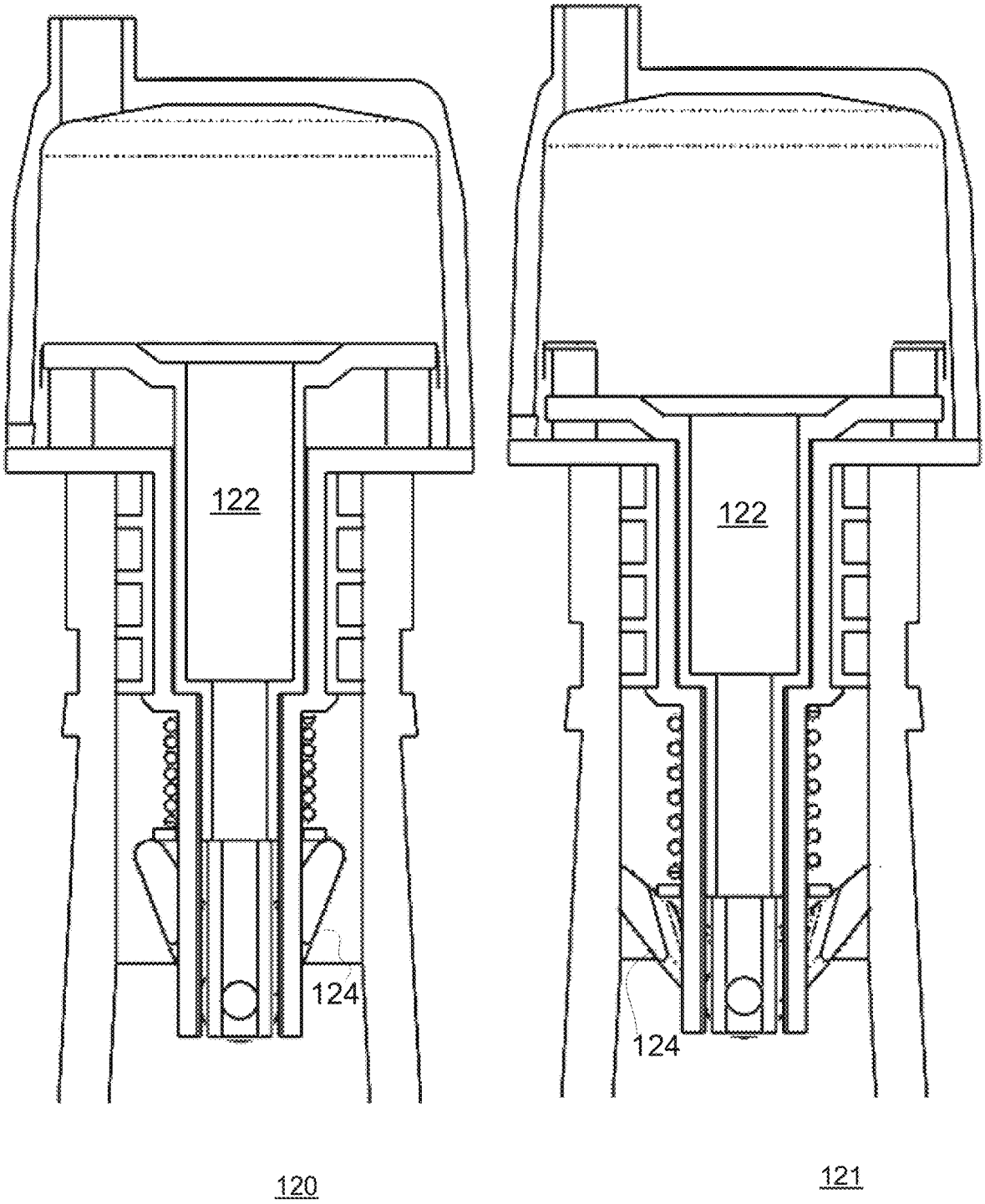

FIGS. 19-20 illustrates additional examples of a controlled pourer.

In FIG. 19 a rotational movement at a locking direction of a central element 112 (may include at least a part of the air path and the liquid path) causes an intermediate to rotate in a distal direction—away from the bottle—compress intermediate elements 116 and press structural elements 118 sideways—to lock the controlled pourer towards the bottle.

Reference number 110 refers to a cross sectional view at an unlocked position and reference number 111 refers to a cross sectional view at a locked position.

In FIG. 20, a proximal movement (towards the bottle) of a central element 122 (may include at least a part of the air path and the liquid path) forces wings 124 or any other rotatable elements to rotate sideways and to lock the controlled pourer to the bottle.

Reference number 120 refers to a cross sectional view at an unlocked position and reference number 121 refers to a cross sectional view at a locked position.

In FIGS. 1-18—the following reference numbers are used:

a. Controlled liquid pourer 10.
b. Controller liquid housing 11.
c. Controller liquid pourer output 12.
d. Liquid path 12.
e. Air path 14.
f. Flow control mechanism 20.
g. First liquid conduit 21.
h. First liquid conduit movement mechanism 22.
i. Main air conduit 23.
j. First liquid seal 24.
k. First flow control element 25.
l. Second flow control element 26.
m. First air conduit 27.
n. Second air conduit 28.
o. Seals 29.
p. Bottle 30.
q. Locking mechanism 40.
r. Mechanical coupling mechanism 50.
s. First interfacing element 51.
t. First interfacing part 54.
u. Second interfacing part 56.
v. Second interfacing element 52.
w. Threaded rotatable element 60.
x. Bottle locking elements 70.
y. Limiter mechanism 80.
z. Spring 81.
aa. Pin 82.
bb. Springs housing 83.
cc. Spring spaces 85.
dd. Pins housing 84.
ee. Pins spaces 86.
ff. Tooth 91 of the second interfacing element.
gg. Blocker 92 of the first interfacing element.

There may be provided a controlled liquid pourer 10 that may include a liquid path 12, an air path 14, a locking mechanism 40 configured and a flow control mechanism 20 that may be configured to control, during a liquid consumption iteration, (a) a flow of liquor from a bottle 30 and through the liquid path 12, and (b) a flow of air through the air path 14 and into the bottle 30. The locking mechanism 40 may be configured to selectively lock the controlled liquid pourer 10 to the bottle 30. The flow control mechanism 20 may include a first liquid conduit 21, a first liquid conduit movement mechanism 22, a main air conduit 23 that passes through a threaded rotatable element 60, a first liquid seal 24 that may be connected to the main air conduit 23, a first flow control element 25 and a second flow control element 26; and wherein the first liquid conduit movement mechanism 22 may be configured to move the first liquid conduit between a distal position and a proximal position.

There may be provided a controlled liquid pourer 10 that may include a liquid path 12, an air path 14, a flow control mechanism 20 that may be configured to control, during a liquid consumption iteration, (a) a flow of liquor from a bottle 30 and through the liquid path 12, and (b) a flow of air through the air path 14 and into the bottle 30; a locking mechanism 40 configured to selectively lock the controlled liquid pourer 10 to the bottle 30, and a mechanical coupling mechanism 50.

The locking mechanism 40 and the flow control mechanism 20 may share a threaded rotatable element 60 that may be configured to move, by rotation, between a bottle locking position in which the threaded rotating element presses bottle 30 locking elements against the bottle 30; and a bottle release position in which the threaded rotating does not press the bottle locking elements 70 against the bottle 30.

The mechanical coupling mechanism 50 may be configured to (a) allow, under a bottle release condition, to rotate the threaded rotatable element 60 at a release direction and reach the bottle release position, and (b) prevent, under a bottle lock condition, a rotation of the rotatable upper housing at the release direction.

The mechanical coupling mechanism 50 may include a first interfacing element 51 that has a first interfacing part 55 and a second interfacing part, and a second interfacing element 52 that may be movable between (a) a first position in which the second interfacing element 52 contacts the first interfacing part 55 while not contacting the second interfacing part, and (b) a second position in which the second interfacing element 52 contacts the second interfacing part 56 while not contacting the first interfacing part; wherein when the first interfacing part 55 may be configured to allow a rotation at the release direction; and wherein the second interfacing part 56 may be configured to prevent (see teeth 91 locked between blockers 92 of FIG. 18) of the rotation at the release direction.

The second interfacing part 56 may be movable by gravitation between the first position and the second position.

The second interfacing part 56 may be a gravity ring.

The flow control mechanism 20 may include a first liquid conduit 21, a first liquid conduit movement mechanism 22, a main air conduit 23 that passes through the threaded rotatable element 60, a first liquid seal 24 that may be connected to the main air conduit 23, a first flow control element 25 and a second flow control element 26.

The first liquid conduit movement mechanism 22 may be configured to move the first liquid conduit 21 between a distal position and a proximal position.

When the first liquid conduit 21 is positioned at the distal position, a first air conduit 27 within the first flow control element 25 may be misaligned with a second air conduit 28 of the second flow control element 26, and the liquid seal seals 29 the threaded rotatable element 60.

At least one of the first flow control element 25 and the second flow control element 26 may include one or more seals 29 for sealing the first air conduit 27 from the second air conduit 28—when the first air conduit 27 and the second air conduit 28 are misaligned.

When the first liquid conduit 21 is positioned at the proximal position, the first air conduit 27 may be aligned with the second air conduit 28, and the liquid seal may be spaced apart from the threaded rotatable element 60.

The controlled liquid pourer 10 may include a limiter mechanism 80 that may be configured to prevent a movement of the first liquid conduit 21 towards the bottle 30 when the first liquid conduit 21 may be at a first fluid conduit position and to allow the movement of the first liquid conduit 21 to the preform the movement from the distal location to the proximal position.

The limiter mechanism 80 may include springs and pins; wherein the springs are configured to force the pins 82 to move towards an interior of the first liquid conduit 21.

The limiter mechanism 80 may include a springs housing 83 that may include spring spaces 85 in which the springs are positioned, and a pins housing 83 that may include pins spaces 86 in which the pins are positioned; wherein the springs housing 83 may be movable in relation to the pins housing.

The first liquid conduit 21 may be configured to move the springs housing 83 when moved by the first liquid conduit movement mechanism 22.

The air path 14 may be formed, at least in part, by one or more openings of a rotatable housing, a first air conduit 27 within the first flow control element, a second air conduit 28 of the second flow control element 26, and the main air conduit 23.

It should be noted that the controlled liquid pourer may include a controller that may be configured to control at least the first liquid conduit movement mechanism 22. The controller may be controlled by a remote controller, may be controlled in any manner—wireless transmission, voice recognition, and the like. The controller may be configured to receive sensed information—for example from an inclination sensor—and may determine, at least in part based on the inclination of the bottle—when to allow a pouring of liquid, and the like.

There may be provided a method for controlling a provision of liquid using any of the controlled liquid pourers mentioned in the application.

In the foregoing specification, the embodiments of the disclosure has been described with reference to specific examples of embodiments of the disclosure. It will, however, be evident that various modifications and changes may be made therein without departing from the broader spirit and scope of the embodiments of the disclosure as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the disclosure described herein are, for example, capable of operation in other orientations than those illustrated or otherwise described herein.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to be a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to embodiments of the disclosure s containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

While certain features of the embodiments of the disclosure have been illustrated and described herein, many modifications, substitutions, changes, and equivalents will now occur to those of ordinary skill in the art. It is, therefore, to be understood that the appended claims are intended to cover all such modifications and changes as fall within the true spirit of the embodiments of the disclosure.

I claim:

1. A controlled liquid pourer, comprising:

a liquid path;

an air path;

a flow control mechanism that is configured to control, during a liquid consumption iteration, (a) a flow of liquor from a bottle and through the liquid path, and (b) a flow of air through the air path and into the bottle; and a locking mechanism configured to selectively lock the controlled liquid pourer to the bottle;

wherein the locking mechanism and the flow control mechanism share a threaded rotatable element that is configured to move, by rotation, between a bottle locking position in which the threaded rotatable element presses bottle locking elements against the bottle; and a bottle release position in which the threaded rotatable element does not press the bottle locking elements against the bottle; and a mechanical coupling mechanism that is configured to (a) allow, under a bottle release condition, to rotate the threaded rotatable element at a release direction and reach the bottle release position, and (b) prevent, under a bottle lock condition, a rotation of the rotatable upper housing at the release direction.

2. The controlled liquid pourer according to claim 1, wherein the mechanical coupling mechanism comprises a first interfacing element that has a first interfacing part and a second interfacing part, and a second interfacing element that is movable between (a) a first position in which the second interfacing element contacts the first interfacing part while not contacting the second interfacing part, and (b) a second position in which the second interfacing element contacts the second interfacing part while not contacting the first interfacing part; wherein when the first interfacing part is configured to allow a rotation at the release direction; and wherein the second interfacing part is configured to prevent the rotation at the release direction.

3. The controlled liquid pourer according to claim 2 wherein the second interfacing part is movable by gravitation between the first position and the second position.

4. The controlled liquid pourer according to claim 2 wherein the second interfacing part is a gravity ring.

5. The controlled liquid pourer according to claim 1 wherein the flow control mechanism comprises a first liquid conduit, a first liquid conduit movement mechanism, a main air conduit that passes through the threaded rotatable element, a first liquid seal that is connected to the main air conduit, a first flow control element and a second flow control element.

6. The controlled liquid pourer according to claim 5 wherein the first liquid conduit movement mechanism is configured to move the first liquid conduit between a distal position and a proximal position.

7. The controlled liquid pourer according to claim 6 wherein when the first liquid conduit is positioned at the distal position, a first air conduit within the first flow control element is misaligned with a second air conduit of the second flow control element, and the first liquid seal seals the threaded rotatable element.

8. The controlled liquid pourer according to claim 7 wherein at least one of the first flow control element and the second flow control element comprises one or more seals for sealing the first air conduit from the second air conduit—when the first air conduit and the second air conduit are misaligned.

9. The controlled liquid pourer according to claim 7 wherein when the first liquid conduit is positioned at the proximal position, the first air conduit is aligned with the second air conduit, and the first liquid seal is spaced apart from the threaded rotatable element.

10. The controlled liquid pourer according to claim 6 comprises a limiter mechanism that is configured to prevent a movement of the first liquid conduit towards the bottle when the first liquid conduit is at a first fluid conduit position and to allow the movement of the first liquid conduit to the preform the movement from the distal location to the proximal position.

11. The controlled liquid pourer according to claim 10 wherein the limiter mechanism comprises springs and pins; wherein the springs are configured to force the pins to move towards an interior of the first liquid conduit.

12. The controlled liquid pourer according to claim 11 wherein the limiter mechanism comprises a springs housing that comprises spring spaces in which the springs are positioned; and a pins housing that comprises pins spaces in which the pins are positioned; wherein the springs housing is movable in relation to the pins housing.

13. The controlled liquid pourer according to claim 12 wherein the first liquid conduit is configured to move the springs housing when moved by the first liquid conduit movement mechanism.

14. The controlled liquid pourer according to claim 1 wherein the air path is formed, at least in part, by one or more openings of a rotatable housing, a first air conduit within the first flow control element, a second air conduit of the second flow control element, and the main air conduit.

15. A controlled liquid pourer, comprising:

a liquid path;

an air path;

a flow control mechanism that is configured to control, during a liquid consumption iteration, (a) a flow of liquor from a bottle and through the liquid path, and (b) a flow of air through the air path and into the bottle; and a locking mechanism configured to selectively lock the controlled liquid pourer to the bottle;

wherein the flow control mechanism comprises a first liquid conduit, a first liquid conduit movement mechanism, a main air conduit that passes through a threaded rotatable element, a first liquid seal that is connected to the main air conduit, a first flow control element and a second flow control element; and wherein the first liquid conduit movement mechanism is configured to move the first liquid conduit between a distal position and a proximal position.

16. The controlled liquid pourer according to claim 15 wherein when the first liquid conduit is positioned at the distal position, a first air conduit within the first flow control element is misaligned with a second air conduit of the second flow control element, and the first liquid seal seals the threaded rotatable element.

17. The controlled liquid pourer according to claim 15 wherein when the first liquid conduit is positioned at the distal position, a first air conduit within the first flow control element is misaligned with a second air conduit of the second flow control element, and the first liquid seal seals the threaded rotatable element.

18. The controlled liquid pourer according to claim 17 wherein at least one of the first flow control element and the second flow control element comprises one or more seals for sealing the first air conduit from the second air conduit—when the first air conduit and the second air conduit are misaligned.

19. The controlled liquid pourer according to claim 17 wherein when the first liquid conduit is positioned at the proximal position, the first air conduit is aligned with the second air conduit, and the first liquid seal is spaced apart from the threaded rotatable element.

20. The controlled liquid pourer according to claim 15 comprises a limiter mechanism that is configured to prevent a movement of the first liquid conduit towards the bottle when the first liquid conduit is at a first fluid conduit position and to allow the movement of the first liquid conduit to the preform the movement from the distal location to the proximal position.

21. The controlled liquid pourer according to claim 20 wherein the limiter mechanism comprises springs and pins; wherein the springs are configured to force the pins to move towards an interior of the first liquid conduit.

22. The controlled liquid pourer according to claim 21 wherein the limiter mechanism comprises a springs housing that comprises spring spaces in which the springs are positioned; and a pins housing that comprises pins spaces in which the pins are positioned; wherein the springs housing is movable in relation to the pins housing.

23. The controlled liquid pourer according to claim 22 wherein the first liquid conduit is configured to move the springs housing when moved by the first liquid conduit movement mechanism.

24. The controlled liquid pourer according to claim 15 wherein the air path is formed, at least in part, by one or more openings of a rotatable housing, a first air conduit within the first flow control element, a second air conduit of the second flow control element, and the main air conduit.

25. The controlled liquid pourer according to claim 15 wherein the locking mechanism and the flow control mechanism share the threaded rotatable element, wherein the threaded rotatable element is configured to move, by rotation, between a bottle locking position in which the threaded rotatable element presses bottle locking elements against the bottle; and a bottle release position in which the threaded rotatable element does not press the bottle locking elements against the bottle.

26. The controlled liquid pourer according to claim 25 comprising a mechanical coupling mechanism that is configured to (a) allow, under a bottle release condition, to rotate the threaded rotatable element at a release direction and reach the bottle release position, and (b) prevent, under a bottle lock condition, a rotation of the rotatable upper housing at the release direction.

* * * * *